United States Patent [19]

Boosalis et al.

[11] 4,362,698

[45] Dec. 7, 1982

[54] CLOSURES FOR FLUID SAMPLE CUPS

[75] Inventors: Nicholas T. Boosalis; George E. Sherman, both of Minneapolis, Minn.

[73] Assignee: Sherman-Boosalis Corporation, Minneapolis, Minn.

[21] Appl. No.: 128,075

[22] Filed: Mar. 7, 1980

[51] Int. Cl.[3] ..... B01L 3/00; B65D 51/00; B65D 41/00

[52] U.S. Cl. ..... 422/102; 215/232; 215/247; 220/359; 220/229

[58] Field of Search ..... 220/359, 229; 128/295, 128/760; 215/232, 320, 307, 247; 422/102, 99

[56] References Cited

U.S. PATENT DOCUMENTS

| | | | |
|---|---|---|---|
| 2,213,465 | 9/1940 | Gay | 220/229 |
| 3,938,686 | 2/1976 | Milligan et al. | 215/232 |
| 3,999,949 | 12/1976 | Anderson et al. | 422/102 |
| 4,171,084 | 10/1979 | Smith | 215/232 |

FOREIGN PATENT DOCUMENTS

| | | | |
|---|---|---|---|
| 2753239 | 6/1979 | Fed. Rep. of Germany | 215/232 |
| 53-8273 | 3/1978 | Japan | 215/232 |
| 472091 | 9/1937 | United Kingdom | 215/247 |

*Primary Examiner*—Frank W. Lutter
*Assistant Examiner*—Chris Konkol
*Attorney, Agent, or Firm*—Wicks & Nemer

[57] ABSTRACT

Closures for fluid sample cups, preferably for blood, according to the teachings of the present invention are preferably formed in a multilayered sheet including a matrix of closures and remaining area located around and between the closures. Specifically, the multilayered sheet includes two sided adhesive tape sandwiched between a layer of adhesive covering paper and a rigidifying layer. An elastic layer is adhesively secured to the rigidifying layer. A matrix of first apertures extend through the tape, the paper layer, and the rigidifying layer, with the material located inside of the first apertures being discarded. A matrix of second apertures extend through the tape and the elastic and rigidifying layers concentric with and of greater radius than the first apertures and which define the matrix of the closures. A matrix of slits are also formed in the elastic layer within the first apertures. The slits in the closure allow pipettes of blood analyzers to forgivingly extend through the closure without piercing it and allow wiping of blood residue from the pipette as it is being removed. Due to the elastic characteristics of the elastic layer, sealing occurs between the slits themselves and with the pipette before entry, while entering, while through, and after removal of the pipette from the slits of the closure to thus greatly aid in preventing evaporation.

28 Claims, 7 Drawing Figures

CLOSURES FOR FLUID SAMPLE CUPS

BACKGROUND

The present invention relates generally to closures for fluid sample cups, preferably blood sample cups, and methods of making the same.

Prior to the present invention, errors in blood analyzing occurred as a result of evaporation of water from the blood sample and as a result of contamination of the blood sample which occurred while the sample was located in the sample cup awaiting analysis. Thus, a need has arisen for a closure which prevents evaporation and contamination of the blood sample.

Past attempts to combat this problem of evaporation and contamination, while reducing this problem, have been ineffective in overcoming it. Further, some of the attempts have prevented the automatic operation of blood analyzers in that the pipette could not pierce the closures and thus prior closures had to be removed from the sample cups before analysis. Specifically, prior closures which were individually applied to sample cups in a rotary tray of the analyzer had to be hand removed before operation of the analyzer which is very awkward and slow while closures which covered all the sample cups in the rotary tray were easily removable but were not effective in preventing evaporation and contamination. Thus, a need has arisen for a closure which may remain on the sample cup and allow the automatic operation of the blood analyzer.

Further, errors in blood analyzing occurred because residue of blood serum remained on the pipette of the blood analyzer and thus was transferred to the next sample cup. Thus, a need has arisen for preventing such blood residue transference between samples.

SUMMARY

The present invention solves these and other problems by providing a closure for fluid sample cups, preferably blood sample cups. In the preferred embodiment, the blood sample cup closures are manufactured in multilayered sheets including a matrix of closures.

Also, in the preferred embodiment, the blood sample cup closure includes slits for allowing the pipette of a blood analyzer to forgivingly extend through without piercing the closure and for allowing wiping of the blood residue from the pipette as it is removed from the closure.

Furthermore, in the preferred embodiment, the blood sample cup closure is sufficiently elastic to allow sealing between the slits themselves and the pipette before the pipette extends through the slits, while the pipette is extending through the slits, and after the pipette has been removed from the slits.

It is thus a primary object of the present invention to provide novel closures for fluid sample cups.

It is a further object of the present invention to provide a novel method for making closures for fluid sample cups.

It is a further object of the present invention to provide such novel closures which greatly aid in eliminating evaporation and contamination of the blood sample.

It is a further object of the present invention to provide such novel closures which allow automatic operation of blood analyzers.

It is a further object of the present invention to provide such novel closures which seal with the sample cut but allow the pipette of the analyzer to forgivingly extend therethrough without piercing the closures.

It is a further object of the present invention to provide such novel closures which greatly aid in the provision of a sealed environment with the sample cup at all times including during entry and removal of the pipette through the closure.

It is a further object of the present invention to provide such novel closures located in sheets for easy handling.

It is a further object of the present invention to provide such novel closures which are easy to manufacture in sheets.

It is a further object of the present invention to provide such novel closures which are inexpensive.

It is a further object of the present invention to provide such novel closures which may be disposable with the sample cups after analyzation has been completed.

It is a further object of the present invention to provide such novel closures which prevent spillage of the sample from the sample cups.

These and further objects and advantages of the present invention will become clearer in the light of the following detailed description of an illustrative embodiment of this invention described in connection with the drawings.

DESCRIPTION OF THE DRAWINGS

The illustrative embodiment may best be described by reference to the accompanying drawings where.

Figure 1:
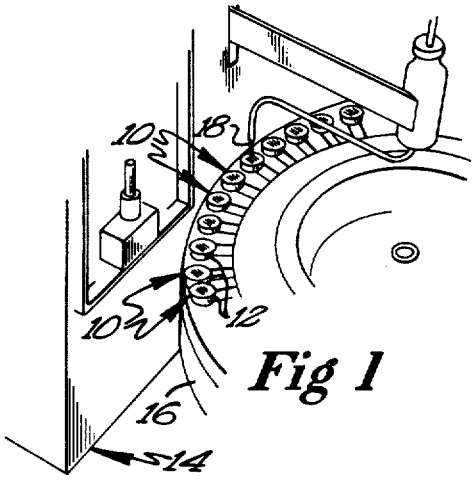
FIG. 1 shows a perspective view of a blood analyzer utilizing sample cups having closures according to the teachings of the present invention.

All figures are drawn for ease of explanation of the basic teachings of the present invention only; the extensions of the figures with respect to number, position, relationship, and dimensions of the parts to form the preferred embodiment will be explained or will be obvious from the explanation.

Where used in the various figures of the drawings, the same or similar numerals designate the same or similar portions of the closure. Furthermore, when the terms "right", "left", "side", "first", "second", and similar terms are used herein, it should be understood that these terms have reference only to the structure shown in the drawings as it would appear to a person viewing the drawings and are utilized only to facilitate describing the invention.

DESCRIPTION

A sample closure or cap according to the teachings of the present invention is generally shown in the drawings and designated 10. Closure 10 is used to close fluid, and preferably blood, sample cups 12 for use in automatic chemistry analyzers 14, partially shown. Analyzers 14 may be of the type shown in FIG. 1 or any similar type such as models Smac, 1260, or 660 manufactured by Technicon Instruments Corporation, model Gemsac manufactured by Electro-Nucleonics, Inc., model Centrifichem manufactured by Union Carbide Corporation, models MCA or 7 Channel manufactured by Instrumentation Laboratory, Inc., models Astra 8 or Astra 4 manufactured by Beckman Instruments, Inc., models VP, ABA 100, or ABA 500 manufactured by Abbott Laboratories, model 3500 manufactured by Gilford Instrument Laboratories, Inc., model Hycel 16 manufactured by Hycel, Inc., model Nova 1 manufactured by Nova Biomedical, or possibly many others in existence or to be devised. Analyzer 14 shown generally includes a rotary tray 16 including a multitude of sample cups 12. Cups 12 include an interior for holding a sample of blood serum for analysis and include an open end having a dimension defined by the cup rim. Tray 16 rotates under a pipette 18 of analyzer 14 which is automatically lowered through the open end and into the interior of sample cup 12 where a sample of blood serum may be withdrawn therefrom for analyzing. After one sample has been completed, and the pipette withdrawn, tray 16 can rotate, thus placing the next sample cup 12 under pipette 18, and the process repeated.

Figure 2:
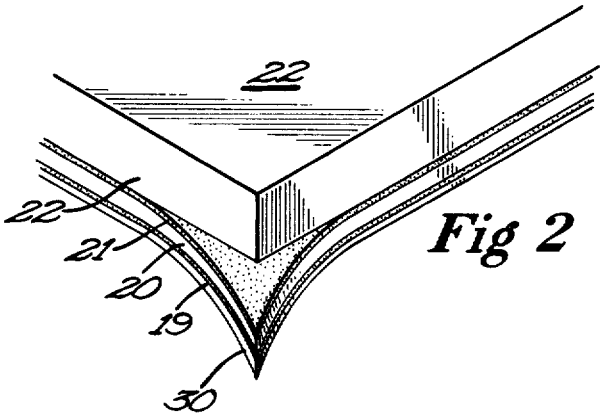
FIGS. 2 through 6 show the steps in manufacturing closures of FIG. 1 according to the teachings of the present invention.
Figure 3:
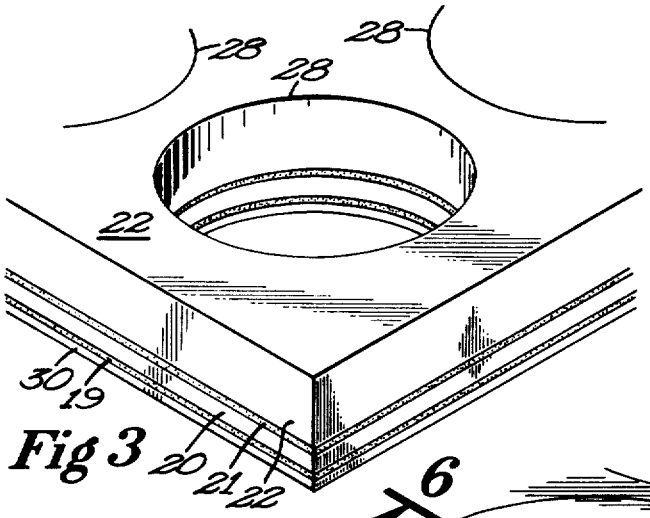
Figure 4:
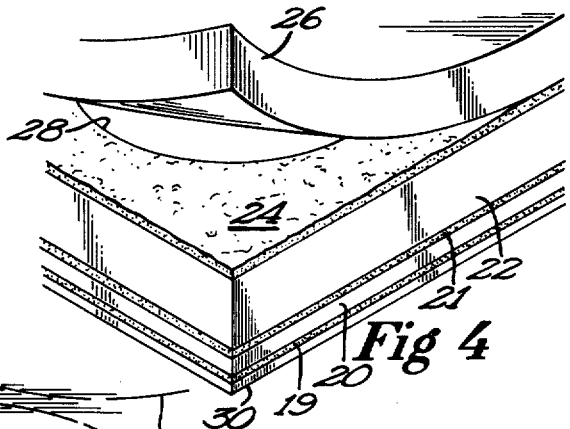
Figure 5:
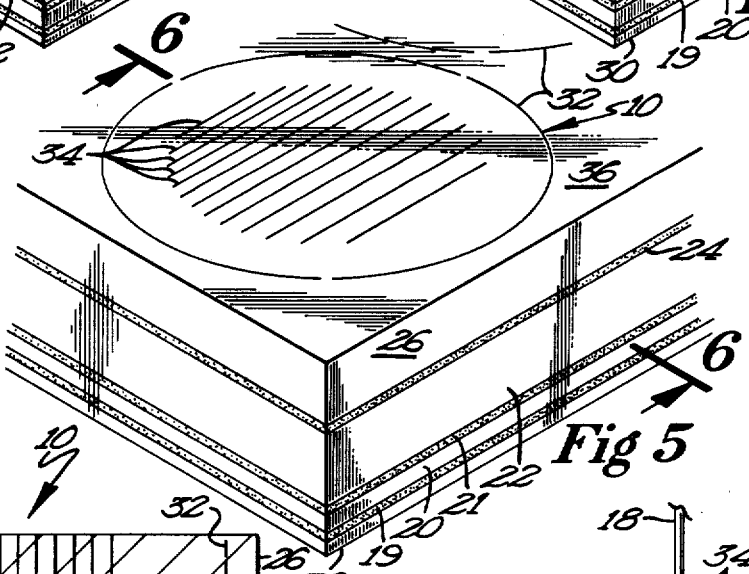
Figure 6:
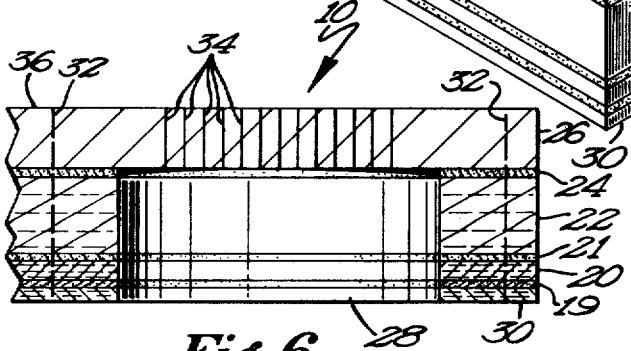
Figure 7:
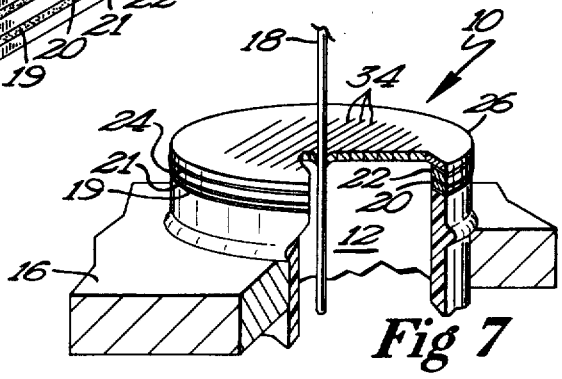
FIG. 7 shows a partial cross sectional view of the closure of FIG. 1 sealed and secured to a blood sample cup located in a blood analyzer, with the pipette of the blood analyzer extending therethrough.

Closures 10 are preferably manufactured in sheets and in the preferred embodiment are comprised of a two-sided pressure sensitive tape 20, a rigidifying layer 22, adhesive 24, and an elastic layer 26. Specifically, in manufacturing closures 10, one side of tape 20 includes pressure sensitive adhesive 19 covered by a layer of adhesive covering paper 30, while the other side of tape 20, the pressure sensitive adhesive 21 is exposed before its attachment to layer 22. Layer 22 is then placed upon the exposed adhesive 21 of tape 20 and pressure is applied thereto such that layer 22 is adhered to tape 20 as shown in FIG. 2. First apertures 28 are then die cut through the combined layers of tape 20, layer 22, and paper 30. The portions or material located within apertures 28 may be removed and discarded as shown in FIG. 3. Adhesive 24 is then applied to the exposed surface of layer 22 around and between apertures 28. Layer 26 is then placed upon adhesive 24 which has been applied on layer 22 as shown in FIG. 4. Slits 34 may then be die cut through layer 26 within the perimeter of apertures 28, and second apertures 32 are kiss cut through layers 26 and 22, tape 20, and adhesive 24 concentric with and of greater radius than apertures 28, as shown in FIGS. 5 and 6. Thus, the combined layers 26 and 22, tape 20, and adhesive 24 include closures 10 defined by apertures 32 and the remaining area 36 located outside of apertures 32, or in other words around and between apertures 32. Area 36 then comprises the scrap and trim or "scrim" of the manufacturing process.

It should be noted that in the preferred embodiment, layer 26 is stretched upon layer 22 in the direction of slits 34 while slits 34 are being cut. It has been found that better sealing between slits 34 occurs after pipette 18 is withdrawn when layer 26 is stretched during cutting of slits 34 than when layer 26 is not so stretched. Furthermore, in the preferred embodiment, slits 34 are cut prior to the cutting of apertures 32 but slits 34 and apertures 32 may be cut simultaneously.

Apertures 28 have dimensions, diameters and circumferences less than the dimensions, diameters, and circumferences of sample cups 12 and in the preferred embodiment are circular and have diameters approximately equal to 13/32 of an inch. It should then be noted apertures 28 cannot be too small in that the area of slits 34, or in other words the probe area, becomes too small and cannot be too large because the ring of rigidifying layer 22 formed between apertures 28 and 32 may become too flimsy to hold layer 26 in a stretched manner and also because a good sealing relationship between closure 10 and cup 12 may not be insured. Furthermore, if closure 10 is too flimsy, closures 10 may fold when held by its edge between the fingers of the user during application. Apertures 32 have dimensions, diameters and circumferences greater than the dimensions, diameters, and circumferences of sample cups 12 and the dimensions, diameters, and circumferences of apertures 28, and in the preferred embodiment are circular and have diameters approximately equal to 21/32 of an inch. It should then be noted that apertures 32 cannot be too small because the ring of rigidifying layer 22 formed between apertures 28 and 32 may become too flimsy to hold layer 26 in a stretched manner and also because a good sealing relationship between closure 10 and cup 12 may not be insured. Furthermore, if closure 10 is too flimsy, closures 10 may fold when held by its edge between the fingers of the user during application. Apertures 32 cannot be too large because closures 10 would interfere with each other when cups 12 were placed in tray 16 of analyzer 14. Thus, the dimensions of closure 10 allow placement of closure 10 on the rim of cup 12 to effectively seal cup 12 against evaporation from within cup 12 and against contamination from without cup 12. Closures 10 utilizing the dimensions of apertures 28 and 32 of the preferred embodiment of the present invention may be used with over 90% of all of the various types of sample cups 12 presently available on the market and which, in turn, means that closures 10 can be used with nearly all of the automatic analyzers available. It should also be noted that the dimensions of apertures 28 and 32 can be increased or decreased according to the particular cup 12 used or desired.

Furthermore, the dimensions of apertures 32 of the preferred embodiment also assist in centering closure 10 on cup 12 automatically and without great concern by the user in that when closure 10 is held between the thumb and forefinger about the edge of closure 10, or in other words, about the circumference of aperture 32, the thumb and forefinger rub with the outer circumference of the sample cup 12 now generally used when closure 10 is being placed thereon.

In the preferred embodiment, apertures 28 and 32 and slits 34 are made by dies designed to do several such cuts simultaneously. In kiss cutting apertures 32, apertures 32 are cut through layer 26, adhesive 24, layer 22, and tape 20 but either do not cut or only partially cut layer 30. Thus, closures 10 remain in multilayered sheets with remaining area 36. Closures 10 and area 36 remain attached to layer 30 and do not fall therefrom. Thus, a matrix of a plurality of closures 10 may be sold in sheets with remaining area 36 both attached to layer 30 or remaining area 36 can be removed leaving only closures 10 attached to layer 30. In addition to allowing ease of handling and packaging during the sale and distribution of closures 10, closures 10 attached in sheets to layer 30 also allow for the sanitary handling at the time of use. Specifically, since layer 30 is not cut fully, closure 10 can be easily pealed therefrom by simply folding layer 30 adjacent closure 10 which causes layer 30 to pull from closure 10 making it possible to grasp closure 10 by its edge between the thumb and forefinger of the user. When layer 30 is removed from tape 20 of closure 10, adhesive 19 on tape 20 is exposed.

The stretching of layer 26 insures that layer 26 remains in a stretched relationship over aperture 28 and does not sag therein, especially during cutting of slits 34 and during insertion and removal of pipette 18 during use. After cutting apertures 32 and slits 34, the perimeter edges of the multilayer sheet of closures 10 comprising layers 26, 22, and 30, tape 20 and adhesive 24 can then be trimmed, and the sheets of closure 12 can be placed in suitable packaging.

Closures 10 of the present invention may then be used as follows. After a blood sample has been centrifuged, the blood serum may be removed from the centrifuge tube and placed in a sample cup 12 which is placed in tray 16 with other cups 12 to await analysis. During the time from when the blood serum is placed in cup 12 until pipette 18 takes a sample therefrom, contamination from the air may enter cup 12 and may contaminate the serum located in cup 12, thus making the analysis by analyzer 14 inaccurate. But, more importantly, evaporation of water occurs from the serum in cup 12 thus increasing the concentrations of the blood serum, thereby making the analysis by analyzer 14 inaccurate. As set forth in the article entitled FACTORS INFLUENCING EVAPORATION FROM SAMPLE CUPS AND ASSESSMENT OF THEIR EFFECT ON ANALYTICAL ERROR by C. A. Burtis, J. M. Begovich and J. S. Watson appearing in *CLINICAL CHEMISTRY*, 1975, 21 (13), this evaporation of water vapor from the blood serum is a serious problem in blood analysis and attempts have been made to combat this problem. However such attempts have been only helpful in reducing this problem and have been ineffective in overcoming it.

In using closure 10, after blood serum has been placed in cup 12, a closure 10 is removed from the sheet of closures 10 by folding layer 30 adjacent to an individual closure 10 and separating closure 10 from layer 30. Closure 10 can then be grasped around its outer circumference, defined by aperture 32, between two fingers of the user. When removed from the sheet of closures 10 and layer 30, adhesive 19 of tape 20 of closure 10 is exposed. Closure 10 may then be placed on cup 12 such that exposed adhesive 19 of tape 20 is located downward on the rim of cup 12. Pressure then may be applied to closure 10 on cup 12 by the finger of the user to insure that tape 20 of closure 10 adheres and seals with all portions of the rim of cup 12.

With closure 10 adhered to cup 12, closure 10 provides an evaporation seal for preventing evaporation of water from the blood serum located in cup 12 and also provides a contamination seal for cup 12. Closure 10 substantially prevents evaporation from the blood serum located in cup 12, and tests using closure 10 of the present invention have found that evaporation from cup 12 using closure 10 was insignificant for an 8-hour period. For example, an evaporation test was carried out analyzing sodium and potasium on a NOVA 1 blood analyzer. Two cups of identical serum were allowed to stand at room temperature, one cup was covered with closure 10 according to the teachings of the present invention and one was left open as in the prior art. Both cups were analyzed at timed intervals and the following is the data from this test:

| | Open Cup | | Cup Closed with Closure 10 | |
|---|---|---|---|---|
| Time | Na | K | Na | K |
| 900 | 151.8 | 7.36 | 151.1 | 7.38 |
| 1000 | 154.0 | 7.52 | 151.0 | 7.35 |
| 1100 | 154.1 | 7.50 | 150.7 | 7.37 |
| 1200 | 155.4 | 7.58 | 151.3 | 7.38 |
| 1300 | 156.1 | 7.58 | 150.6 | 7.32 |
| 1400 | 158.2 | 7.68 | 151.1 | 7.29 |

-continued

| | Open Cup | | Cup Closed with Closure 10 | |
|---|---|---|---|---|
| Time | Na | K | Na | K |
| 1500 | 159.6 | 7.72 | 151.8 | 7.35 |
| 1525 | 160.5 | 7.72 | 151.9 | 7.33 |

Thus, the cup with closure 10 showed no evidence of evaporation. However, it should then be noted that the concentrations of sodium and potassium increased significantly in the cup that was left open. These same concentrations remained constant in the cup covered using closure 10. It should then be noted that variations in readings in the cup covered by closure 10 appear to define the test accuracy.

Further, closure 10 allows pipette 18 to penetrate closure 10 such that closure 10 does not have to be removed from cup 12. This then allows automatic operation of pipette 18 in analyzer 14. Specifically, slits 34 of closure 10 allow the insertion and withdrawal of pipette 18 into the interior of cup 12. Even while pipette 18 extends into the interior of cup 12, layer 26 seals with pipette 18 and also with cup 12. Therefore, the interior of cup 12, for all intents and purposes, remains sealed to prevent evaporation of the blood serum located in cup 12 even while pipette 18 extends through closure 10. This feature of closure 10 is a major advantage of the present invention. Specifically, prior to the present invention, closures that existed in the art had to be removed from cups 12 in that pipette 18 could not pierce or extend through such prior closures. Thus, automatic operation of an analyzer such as analyzer 14 was not allowed. Further, if the closures were made of very thin material which could be pierced by pipette 18, such very thin closures were prone to breaking and thus not sealing cup 12 and were very expensive in manufacture. Further, such very thin closures did not remain sealed with pipette 18 when pipette 18 was located within the interior of cup 12 and did not include provisions for resealing after pipette 18 was removed. Due to slits 34, pipette 18 does not have to pierce closure 10 but rather can enter through one of slits 34.

Further, when pipette 18 is being removed from cup 12, closure 10 tends to wipe any residue blood serum that is located on the outside surface of pipette 18. Specifically, the material of layer 26 around the slits 34 through which pipette 18 entered tend to wipe such blood serum from the outside surface of pipette 18. This substantially reduces the transference of residue blood serum from one sample to another as could have occurred prior to the present invention.

After pipette 18 is removed from closure 10, closure 10 reseals again such that the blood serum in cup 12 is again sealed within cup 12 by closure 10. Therefore, closure 10 remains intact even after repeated samplings of the blood serum in cup 12 by pipette 18 and is forgivingly resealable after sampling. Thus, pipette 18 forgivingly extends through layer 26 in that layer 26 returns to its original condition after pipette 18 is withdrawn without damage and pipette 18 can again be extended therethrough as often as desired without exposing the sample to evaporation or contamination.

Thus, closure 10 allows continuous sealing of cup 12 from the time the blood serum is placed within the interior of cup 12 until cup 12 is disposed of after completion of all tests desired for the blood serum. Furthermore, closure 10 provides spill prevention in that the sample of the blood serum will not escape or spill from cup 12 through closure 10 if cup 12 should be accidently tipped or knocked over.

Now that the structure, method of manufacture, use, and some advantages have been set forth, the parameters and subtle features and advantages of closures 10 according to the teachings of the present invention may be explained and appreciated. Specifically, tape 20, layers 22 and 26, and adhesive 24 must not in any way contaminate the blood serum located in sample cup 12 and thus must be manufactured of inert material insoluble in blood serum. Further, tape 20, layers 22 and 26, adhesive 24, and layer 30 must be able to be handled by human hands without leaving any residue behind, again to prevent contamination. Additionally, tape 20, layers 22, 26, and 30, and adhesive 24 must allow the die cutting of apertures 28 and of slits 34 and the kiss cutting of apertures 32 and also allow the removal of closure 10 from the remaining area 36 of the multilayered sheet.

Further, tape 20 must be able to adhere to the material forming layer 22 and also to the material forming cup 12, usually general purpose or crystal polystyrene. Layer 30 acts as an adhesive covering for tape 20 in preventing the adhesive of tape 20 from drying. Layer 30 must have sufficient strength to maintain the matrix of closures 10 in a single sheet and yet be easily removable from tape 20 when desired, such as when a closure 10 is desired to be removed for use. It has been found that pressure sensitive tape No. 465 manufactured by Minnesota Mining and Manufacturing Co. (3M) best meets the above parameters for tape 20 and paper 30.

Second layer 22 is preferably constructed of a material having semi-rigid characteristics which will sufficiently rigidify closures 10 for stretching layer 26 across apertures 28 of closures 10 and which creates a flat surface for insuring sealing contact by tape 20 with sample cup 12. In the preferred embodiment, layer 22 is formed of bleached tag board (paper) and has a thickness in the range of 11 mills or thousands of an inch and, in the perferred embodiment, layer 22 is 11 mills thick. It has been found if layer is too thick, problems in manufacturing closures 10 occur when using a stamping technique and specifically in kiss-cutting apertures 32 such that the cut extends through layer 22 without cutting all the way through layer 30. If layer 22 is too thin, closures 10 become to flimsy. When closures 10 are flimsy, sufficient rigidity is not provided such that layer 26 is not held in a stretched relation over apertures 28 but rather closures 10 bow up. Further, when held by its edge between the fingers of the user, closures 10 may fold. Thus, proper sealing is not insured if closures 10 are flimsy.

It should be noted that layer 22 can be formed of other material which meet the parameters of the present invention. Furthermore, where the kiss-cutting of apertures 32 is not desired, further materials can be utilized such as polystyrene or polyethylene foam. However, stress in certain materials, such as high impact polystyrene, created by the kiss and die cutting process used in forming closure 10 may result in a nonflat or bowing surface in layer 22 in closure 10 and thus making a poor sealing relationship in tape 20 and cup 12 making such material undesireable.

Adhesive 24 must be able to adhere to the material forming second layer 22 and also to the material forming layer 26. In the preferred embodiment, adhesive 24 is a water based pressure sensitive acrylate adhesive, and it has been found that Valley Adhesive No. 800-342 manufactured by Valley Adhesives and Coatings Company meets the above parameters for adhesive 24. A film adhesive can also be utilized for adhesive 24 such as transfer adhesive tape and it has been found that transfer adhesive tape No. 950 manufactured by Minnesota Mining and Manufacturing Co. (3M) also meets the above parameters for adhesive 24. While the use of an acrylate adhesive is preferred, the cost of the machinery for applying the film adhesive in manufacturing closures 10 is considerably less than the cost of the machinery necessary for applying the acrylate adhesive. If utilizing a film adhesive, apertures 28 must also extend through the film adhesive forming adhesive 24.

The number of slits 34 in layer 26 is in the range of and approximately equal to 18. If too few slits are provided, the slit area or probe area becomes too small. Specifically, pipette 18 may abut against layer 26 and stop operation. Further, since closures 10 are not identically placed on each cup 12 and since pipette 18 does not extend at the same location in the cups of tray 16 and also between machines, it is desireable to have the probe area as large as possible to insure that pipette 18 extends through slits 34 of layer 26 and to increase useability of closure 10 on all blood analyzers. The maximum number of slits is limited by the area of apertures 28 and the tolerances of manufacture.

The spacing of slits 34 is in the range of 20 mills or thousands of an inch and in the preferred embodiment is approximately 21 mills. It has been found that when separation between slits 34 is 28 mills, operational problems may occur in that pipette 18 may abut with layer 26 between slits 34 and stop operation. And if pipette 18 does extend through slits 34, the drag or friction of layer 26 upon pipette 18 of analyzer 14 may increase enough to lift closure 10 and cup 12 from tray 16 when pipette 18 is raised and when cup 12 is nearly empty, thus not allowing automatic operation of analyzer 14. It has further been found that when the separation between slits 34 is as little as 14 mills, pipette 18 may break layer 26 between slits 34 rather than layer 26 between slits 34 being forced aside by pipette 18. Thus, in the case of a broken layer portion, a sealing relation is not allowed between slits 34 and pipette 18 while pipette 18 extends through closure 10 or between slits 34 when pipette 18 is removed from closure 10.

Layer 26 is manufactured of material which has sufficient elastic characteristics to allow closure 10 having slits 34 to seal between slits 34, to allow pipette 18 of analyzer 14 to forgivingly extend through slits 34 without piercing layer 26 of closure 10, to allow a sealing relation between pipette 18 and slits 34 of closure 10 when pipette 18 is extended therethrough, and to allow resealing between slits 34 of closure 10 after pipette 18 is withdrawn from closure 10. In the preferred embodiment, layer 26 is formed of natural rubber. The thickness of layer 26 is in the range of 7 to 11 mills or thousands of an inch, and in the preferred embodiment is 9 mills thick. If layer 26 has a thickness significantly less than 7 mills, layer 26 has been found to be very flimsy, making manufacture more difficult, and may break when pipette 18 of analyzer 14 extends therethrough and thus exposing the blood serum located in cup 12 to the environment. If layer 26 has a thickness significantly greater than 11 mills, it has been found that too much drag or friction may be created between layer 26 and pipette 18 of analyzer 14 such that closure 10 may be held on pipette 18 when pipette 18 is automatically raised thus also lifting closure 10 and cup 12, making automatic operation of anayizer 14 impossible. Further, manufacturing problems may occur in cutting slits 34 and specifically in insuring that slits 34 are cut all the way through layer 26.

It can then be seen that closure 10 is comprised of two basic parts. Specifically, closure 10 is formed from layer 26 having a plurality of slits 34. Layer 26 is then attached and sealed to the open end or rim of blood sample cup 12 by adhesive 24, layer 22, and tape 20. Specifically, a ring of rigidifying material is formed from layer 22, with the outside dimension, diameter, or circumference of the ring being larger than the dimension, diameter or circumference of the open end of the blood sample cup 12 and with the inside dimension, diameter or circumference of the ring being smaller than the dimension, diameter, or circumference of the open end of blood sample cup 12. The ring of rigidifying material is formed by apertures 28 and 32 cut through layer 22. The ring of rigidifying material is then attached and sealed to layer 26 by adhesive 24 and is in a sealed relationship to the open end or rim of the blood sample cup 12 as a result of tape 20. Specifically, the ring of rigidifying material is attached to a ring of tape 20 having adhesive 21 on a first side attached to the ring of layer 22 and having adhesive 19 on a second side attached to the open end or rim of the blood sample cup 12. The ring of tape is formed by apertures 32 and 28 extending through the layer of tape 20.

Now that the basic teachings of the present invention have been explained, many extensions and variations will be obvious to one having ordinary skill in the art. For example, apertures 32 can be die cut rather than kiss cut such that closures 10 do not remain in a single sheet.

Furthermore, other materials can be utilized from which the layers of closure can be made which meet the parameters of the present invention or only those parameters desired. Also, the dimensions and ranges may vary according to the particular material used.

Thus, since the invention disclosed herein may be embodied in other specific forms without departing from the spirit or the general characteristics thereof, some of which forms have been indicated, the embodiment described herein is to be considered in all respects illustrative and not restrictive. The scope of the invention is indicated by the appended claims, rather than by the foregoing description, and all changes which come within the meaning and range of equivalency of the claims are intended to be embraced therein.

What is claimed is:

1. A multilayer cap for use in connection with blood sample cups used in a blood analyzer including a pipette which enters the blood sample cups through the open end of the sample cup and extends past the rim of the cup into the interior of the cup to thereby remove a sample of the blood from the cup, comprising, in combination: a first layer; a second, rigidifying layer adhered to the first layer; and a third, adhesive layer adhered to the second layer having exposed adhesive allowing the multilayer cap to be adhesively adhered to the rim of the open end of the blood sample cup, with the second and third layers each having a removed portion for allowing the pipette to pass therethrough; means formed in the first layer for allowing the pipette of the blood analyzer to forgivingly extend through the first layer without piercing it and to pass through the removed portions of the second and third layers and into the interior of the sample cup to thereby remove a sample of blood and for insuring the automatic operation of the blood analyzer even though the location where the pipette of the blood analyzer extends into the sample cup varies and theplacement of the cap on the sample cup may vary between the sample cups of the blood analyzer, with the forgivingly extend allowing and automatic operation insuring means comprising an area of slits, with the first layer being formed of material having elastic characteristics allowing sealing of the first layer between the slits before and after entry and withdrawal of the pipette and between the pipette and the slits during and while entry and withdrawal of the pipette, with the slit area being substantially equal to but smaller than the removed portion of the second and third layers to insure that the pipette of the blood analyzer extends into the slit area and not the remaining area of the first layer located outside the slit area, and with the dimensions of the cap allowing placement of the cap on the rim of the blood sample cup to thereby effectively seal the blood sample cup against evaporation from within the cup and against contamination from without the cup.

2. The cap of claim 1 wherein the first layer is formed of natural rubber.

3. The cap of claim 1 or 2 wherein the thickness of the first layer is in the range of 7 to 11 mills.

4. The cap of claim 3 wherein the thickness of the first layer is approximately equal to 9 mills.

5. A multilayer cap for use in connection with blood sample cups used in a blood analyzer including a pipette which enters the blood sample cups through the open end of the sample cup and extends past the rim of the cup into the interior of the cup to thereby remove a sample of the blood from the cup, comprising, in combination: a first layer; a second, rigidifying layer adhered to the first layer; and a third, adhesive layer adhered to the second layer having exposed adhesive allowing the multilayer cap to be adhesively adhered to the rim of the open end of the blood sample cup, with the second and third layers each having a removed portion for allowing the pipette to pass therethrough, with the first layer including slits allowing the pipette of the blood analyzer to forgivingly extend through the slit layer without piercing it and pass through the removed portions of the second and third layers and into the interior of the sample cup to thereby remove a sample of blood, with the first layer being formed of material having elastic characteristics allowing sealing of the first layer between the slits before and after entry and withdrawal of the pipette and between the pipette and the slits during and while entry and withdrawal of the pipette, with the dimensions of the cap allowing placement of the cap on the rim of the blood sample cup to thereby effectively seal the blood sample cup against evaporation from within the cup and against contamination from without the cup, and wherein the spacing between the slits is in the range of 20 mills.

6. The cap of claim 5 wherein the spacing between the slits is approximately equal to 21 mills.

7. The cap of claim 6 wherein the number of slits in the first layer is in the range of 18.

8. The cap of claim 1 or 2 wherein the number of slits in the first layer is in the range of 18.

9. The cap of claim 1 or 2 wherein the second layer is formed of bleached tag board.

10. The cap of claim 9 wherein the thickness of the second layer is in the range of 11 mills.

11. The cap of claim 1 or 2 wherein the third layer is formed of double sided adhesive tape.

12. The cap of claim 1 or 2 wherein the second layer is adhered to the first layer by a water based pressure sensitive acrylate adhesive.

13. Closure for a fluid sample cup, with the sample cup including an interior and an open end having a dimension, and with the sample cup being used in an analyzer including a pipette which enters the sample cup through the open end of the sample cup and extends into the interior of the sample cup, comprising, in combination: a first layer having a thickness and having a dimension larger than the dimension of the open end of the sample cup; means formed in the first layer for allowing the pipette of the analyzer to forgivingly extend through the first layer without piercing it and also allowing wiping of fluid residue from the pipette as it is being removed from the first layer and for insuring the automatic operation of the analyzer even though the location where the pipette of the analyzer extends into the sample cup varies and the placement of the closure on the sample cup may vary between the sample cups of the analyzer, with the forgivingly extend allowing and automatic operation insuring means comprising an area of slits, with the slit area being substantially equal to but being smaller than the dimension of the open end of the sample cup to insure that the pipette of the analyzer extends into the slit area and not the remaining area of the first layer located outside the slit area; means for attaching and sealing the first layer to the open end of the fluid sample cup allowing the insertion and removal of the pipette through the slits of the first layer without the unsealing or separation of the first layer from the open end of the sample cups, with the first layer having elastic characteristics allowing sealing between the slits of the first layer before the pipette extends through the slits of the first layer, allowing sealing between the slits and the pipette when the pipette extends through the slits of the first layer, and allowing resealing between the slits of the first layer after the pipette is removed from the slits of the first layer.

14. The closure of claim 13 wherein the attaching and sealing means includes a ring of tape having adhesive on a first side and on a second side, with the outside dimension of the tape ring being larger than the dimension of the open end of the sample cup and the inside dimension of the tape ring being smaller than the dimension of the open end of the sample cup but allowing the pipette to extend through the inside dimension of the tape ring, with the first layer being adhesively secured to the open end of the blood sample cup by the adhesive on the first side of the tape ring.

15. The closure of claim 14 wherein the attaching and sealing means includes a ring of rigidifying material having a thickness, with the outside dimension of the rigidifying ring being larger than the dimension of the open end of the sample cup and the inside dimension of the rigidifying ring being smaller than the dimension of the open end of the sample cup but allowing the pipette to extend through the inside dimension of the rigidifying ring, with the rigidifying ring being attached and sealed to the first layer and adhesively secured to the open end of the fluid sample cup by the adhesive on the second side of the tape ring.

16. The closure of claim 13 wherein the attaching and sealing means includes a ring of rigidifying material having a thickness, with the outside dimension of the rigidifying ring being larger than the dimension of the open end of the sample cup and the inside dimension of the rigidifying ring being smaller than the dimension of the open end of the sample cup but allowing the pipette to extend through the inside dimension of the rigidifying ring, with the rigidifying ring being attached and sealed to the first layer and in a sealed relation to the open end of the sample cup.

17. The closure of claim 13 or 15 wherein the first layer is formed of natural rubber.

18. The closure of claim 17 wherein the thickness of the first layer is in the range of 7 to 11 mills.

19. The closure of claim 18 wherein the thickness of the first layer is approximately equal to 9 mills.

20. The closure of claim 17 wherein the spacing of the slits is in the range of 20 mills.

21. The closure of claim 20 wherein the spacing of the slits is approximately equal to 21 mills.

22. The closure of claim 17 wherein the number of slits in the first layer is in the range of 18.

23. The closure of claim 15 or 16 wherein the rigidifying ring is formed of bleached tag board.

24. The closure of claim 23 wherein the thickness of the rigidifying ring is in the range of 11 mills.

25. The closure of claim 24 wherein the thickness of the rigidifying ring is approximately equal to 11 mills.

26. The cap of claim 1 wherein the first layer has a sufficient thickness to prevent breakage when the pipette of the blood analyzer extends through the slits but does not create drag or friction with the pipette sufficient to retain the cap on the pipette of the analyzer when the pipette is automatically removed from the open end of the sample cup.

27. The closure of claim 1 wherein the first layer has a sufficient thickness to prevent breakage when the pipette of the analyzer extends through the slits but does not create drag or friction with the pipette sufficient to retain the closure on the pipette of the analyzer when the pipette is automatically removed from the open end of the sample cup.

28. Closure for a fluid sample cup, with the sample cup including an interior and an open end having a dimension, and with the sample cup being used in an analyzer including a pipette which enters the sample cup through the open end of the sample cup and extends into the interior of the sample cup, comprising, in combination: a first layer having a thickness and having a dimension larger than the dimension of the open end of the sample cup; a plurality of parallel slits in the first layer allowing the pipette of the analyzer to forgivingly extend through the first layer without piercing it and also allowing wiping of fluid residue from the pipette as it is being removed from the first layer; means for attaching and sealing the first layer to the open end of the fluid sample cup allowing the insertion and removal of the pipette through the slits of the first layer without the unsealing or separation of the first layer from the open end of the sample cups, with the first layer having elastic characteristics allowing sealing between the slits of the first layer before the pipette extends through the slits of the first layer, allowing sealing between the slits and the pipette when the pipette extends through the slits of the first layer, and allowing resealing between the slits of the first layer after the pipetter is removed from the slits of the first layer.

* * * * *